US006439939B1

(12) United States Patent
Jaeger

(10) Patent No.: US 6,439,939 B1
(45) Date of Patent: Aug. 27, 2002

(54) SIPHON INHIBITING DEVICE FOR A MARINE COOLING SYSTEM

(75) Inventor: Matthew W. Jaeger, Stillwater, OK (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 09/891,121

(22) Filed: Jun. 25, 2001

(51) Int. Cl.[7] ..... B63H 21/38
(52) U.S. Cl. ..... 440/88; 137/217
(58) Field of Search ..... 440/88; 137/215, 137/135, 151, 217

(56) References Cited

U.S. PATENT DOCUMENTS

| | | | | |
|---|---|---|---|---|
| 3,115,114 A | * | 12/1963 | Rapplean et al. | 440/88 |
| 4,838,095 A | * | 6/1989 | Sheridan et al. | 137/551 |
| 5,334,063 A | | 8/1994 | Inoue et al. | 440/88 |
| 5,769,429 A | * | 6/1998 | Smetters et al. | 137/202 |
| 5,980,342 A | | 11/1999 | Logan et al. | 440/88 |
| 6,004,175 A | | 12/1999 | McCoy | 440/88 |
| 6,135,064 A | | 10/2000 | Logan et al. | 123/41 |
| 6,368,169 B1 | * | 4/2002 | Jaeger | 440/88 |

* cited by examiner

*Primary Examiner*—Sherman Basinger
(74) *Attorney, Agent, or Firm*—William D. Lanyi

(57) ABSTRACT

A siphon inhibiting valve comprises first and second portions of a housing structure and a buoyant member disposed within the housing structure for movement along a first axis between an inlet port and an outlet port. The buoyant member is shaped to have a cylindrical portion and another portion which is shaped in the form of a frustum of a cone. Upward movement of the buoyant member causes an elastomeric seal on the buoyant member to come into contact with an internal lip formed in the housing structure, thereby creating a seal that prevents an upward flow of water in a direction from the outlet port to the inlet port. When cooling water is drained from the outlet port area, the buoyant member is forced downwardly into an open position by its own weight and the weight of the water on its inlet port side. This free movement of the buoyant member allows the water on the inlet port side to drain without manual intervention. When normal flow occurs, in a direction from an inlet port to the outlet port, the buoyant member is forced downward into an open position and water flows around the buoyant member from a water pump toward the cooling system of the engine.

18 Claims, 5 Drawing Sheets

SIPHON INHIBITING DEVICE FOR A MARINE COOLING SYSTEM

BACKGROUND OF THE INVENTION

1. Field of the Invention

The present invention is generally related to a siphon inhibiting device for a marine propulsion system and, more particularly, to a siphon inhibiting valve comprises an internally movable buoyant member which is constrained to cause one particular portion of the buoyant member to move into sealing association with an inlet portion of the device.

2. Description of the Prior Art

Those skilled in the art of marine propulsion systems are aware of many different types of engine cooling systems. Typically, a water pump is used to draw water from the body of water in which the marine propulsion system is operated. The water is then conducted through a series of passages and into thermal communication with various heat producing components, such as the engine and its exhaust manifolds. After being used to remove heat from the heat producing components, the water is then typically combined with an exhaust stream from the engine and conducted overboard, back into the body of water from which it was drawn.

U.S. Pat. No. 5,980,342, which issued to Logan et al on Nov. 9, 1999, discloses a flushing system for a marine propulsion engine. The flushing system provides a pair of check valves that are used in combination with each other. One of the check valves is attached to a hose located between the circulating pump and the thermostat housing of the engine. The other check valve is attached to a hose through which fresh water is provided. Both check valves prevent flow of water through them unless they are associated together in locking attachment. The check valve attached to the circulating pump hose of the engine directs a stream of water from the hose toward the circulating pump so that water can then flow through the circulating pump, the engine pump, the heads, the intake manifold, and the exhaust system of the engine to remove seawater residue from the internal passages and surfaces of the engine. It is not required that the engine be operated during the flushing operation.

U.S. Pat. No. 5,334,063, which issued to Inoue et al on Aug. 2, 1994, describes a cooling system for a marine propulsion engine. A number of embodiments of cooling systems for marine propulsion units are disclosed which have water cooled internal combustion engines in which the cooling jacket of the engine is at least partially positioned below the level of the water in which the water craft is operating. The described embodiments all permit draining of the engine cooling jacket when it is not being run. In some embodiments, the drain valve also controls the communication of the coolant from the body of water in which the water is operating with the engine cooling jacket. Various types of pumping arrangements are disclosed for pumping the bilge and automatic valve operation is also disclosed.

U.S. Pat. No. 6,004,175, which issued to McCoy on Dec. 21, 1999, discloses a flush valve which uses only one moving component. A ball is used to seal either a first or second inlet when the other inlet is used to cause water to flow through the valve. The valve allows fresh water to be introduced into a second inlet in order to remove residual and debris from the cooling system of the marine propulsion engine. When fresh water is introduced into a second inlet, the ball seals the first inlet and causes the fresh water to flow through the engine cooling system. When in normal use, water flows through the first inlet and seals the second inlet by causing the ball to move against a ball seat at the second inlet. Optionally, a stationary sealing device can be provided within the second inlet and a bypass channel can be provided to allow water to flow past the ball when the ball is moved against the ball seat at the first inlet. This minimal flow of water is provided to allow lubrication for the seawater pump impeller if the seawater pump is operated during the flushing operation in contradiction to recommended procedure.

U.S. Pat. No. 6,135,064, which issued to Logan et al on Oct. 24, 2000, discloses an improved drain system. The engine cooling system is provided with a manifold that is located below the lowest point of the cooling system of the engine. The manifold is connected to the cooling system of the engine, a water pump, a circulation pump, the exhaust manifolds of the engine, and a drain conduit through which all of the water can be drained from the engine.

The patents described above are hereby expressly incorporated by reference in the description of the present invention.

In certain types of marine propulsion systems, water can drain and thereby create a siphon effect that draws water from other components of the cooling system. When the engine is turned off, cooling water in the outboard drive drains downward to the water line of the body of water in which the boat is operated. This draining initiates a siphon effect which, in turn, draws cooling water from the heated engine in a reverse direction through the cooling circuit. The heated water from the engine then enters and remains in the fuel/water heat exchanger which, in most cases, is a coaxial heat exchanging device. The heated water in this fuel/water heat exchanger causes the liquid fuel to increase in temperature and, in certain cases, vaporize. When the operator of a marine vessel then tries to restart the engine, this partially vaporized fuel in the fuel/water heat exchanger is difficult to displace with the typical electric fuel pump that is normally used. As a result, vapor lock can be experienced.

It would therefore be significantly beneficial if an improved valve could be provided that prevents the siphon effect from draining the water from the cooling system soon after the pump is deactivated, while also avoiding any disadvantages that may have been experienced by users of known anti-siphon valves. It would be further beneficial if the siphon inhibiting means could also allow later draining of the cooling system.

SUMMARY OF THE INVENTION

A siphon inhibiting valve for a marine propulsion system, made in accordance with the preferred embodiment of the present invention, comprises a housing structure having an inlet port and an outlet port. A buoyant member is disposed for movement along the first axis within the housing structure. The buoyant member is inhibited from rotating about a second axis which is perpendicular to the first axis. A sealing surface of the buoyant member is movable into contact with the housing structure proximate the inlet port. In response to movement of the buoyant member toward the inlet port, and into contact with the housing structure, a seal inhibits a liquid from flowing in a reverse direction from the outlet port through the inlet port.

A guide member is disposed within the housing structure and has an opening formed therein which is shaped to receive the buoyant member in sliding relation. The housing structure comprises a first portion and a second portion which are attached together.

The buoyant member comprises a generally cylindrical portion and a portion which is a frustum of a cone. The sealing surface of the buoyant member can comprise an elastomeric insert attached to the buoyant member. Certain embodiments of the present invention further comprise a lip formed in the housing structure surrounding the inlet port, wherein the elastomeric member is shaped to form a seal with the lip when the buoyant member moves toward the inlet port and into contact with the housing structure. The elastomeric insert can be a ring that is shaped to be received in a slot formed in the buoyant member.

The housing structure is intended to be connected in fluid communication with the cooling system of a marine propulsion system, with the inlet port disposed upstream within the cooling system to receive cooling water from a body of water and an outlet port disposed downstream within the cooling system to conduct water to a cooling system of an engine of the marine propulsion system. The buoyant member can be rotatable about the first axis and the buoyant member can be at least partially hollow.

The buoyant member is provided with a generally blunt face at an end of the buoyant member most proximate the inlet port, whereby the buoyant member being inhibited from rotating about the second axis which is perpendicular to the first axis causes the generally blunt face to be maintained in a position facing the inlet port.

BRIEF DESCRIPTION OF THE DRAWINGS

The present invention will be more fully and completely understood from a reading of the description of the preferred embodiment of the present invention in conjunction with the drawings, in which.

DESCRIPTION OF THE PREFERRED EMBODIMENT

Figure 1:
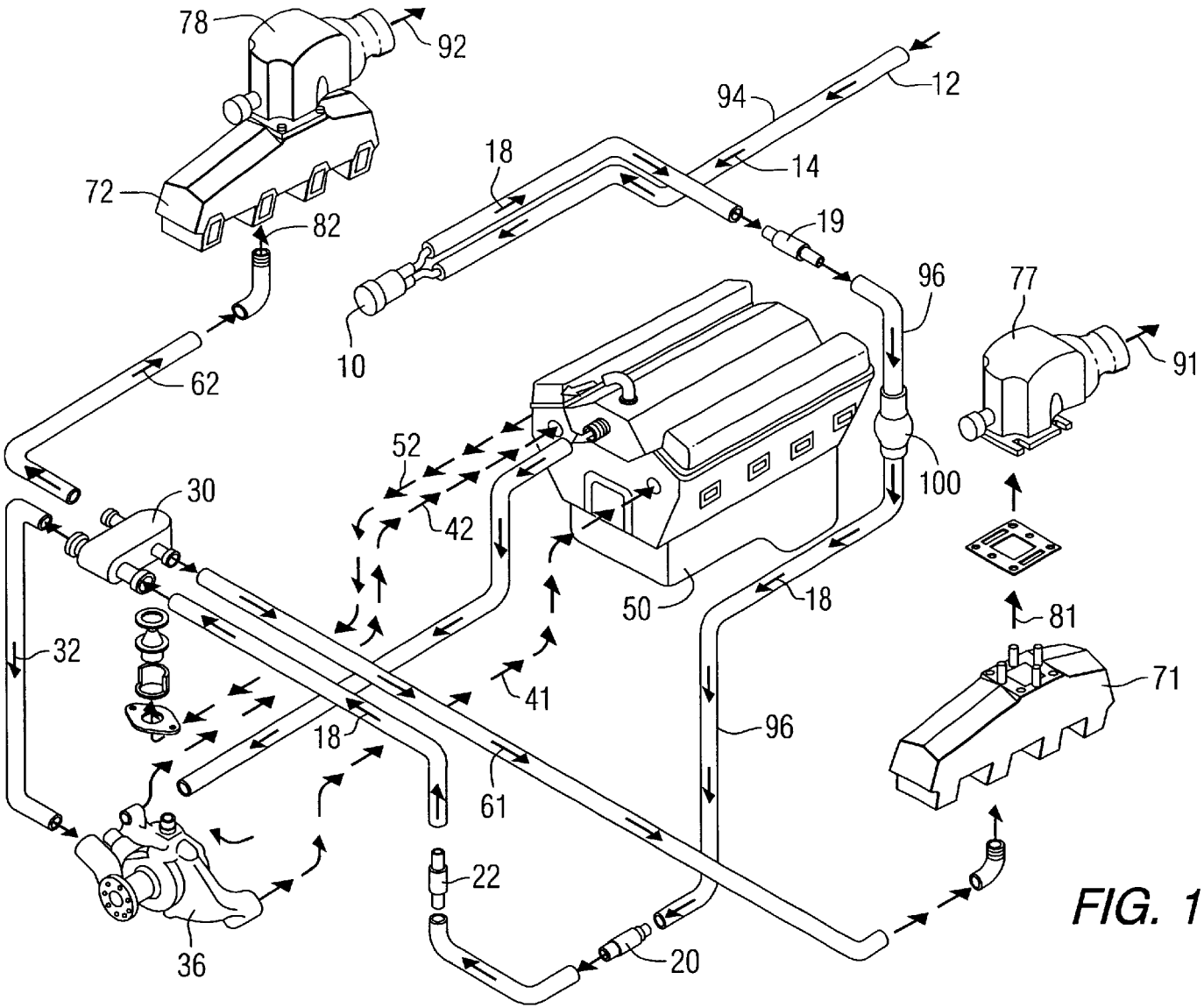
FIG. 1 is an isometric view of relevant components of an engine cooling system of a marine propulsion system.

Throughout the description of the preferred embodiment of the present invention, like components will be identified by like reference numerals.

U.S. Pat. No. 6,368,169, which was filed on Nov. 21, 2000 by Jaeger and assigned to the assignee of the present application, discloses a marine engine cooling system with a siphon inhibiting device. The siphon inhibiting valve is provided for a marine engine cooling system. The purpose of the valve is to prevent the draining of the pump and outboard drive unit from creating a siphon defect that draws water from portions of the cooling system where heat producing components exist. The valve also allows effective draining of the system when the vessel operator desires to accomplish this function. The valve incorporates a ball that is captivated within a cavity. If the ball is lighter than water, its buoyancy assists in the operation of the valve.

While the device described in U.S. Pat. No. 6,368,169 provides a siphon inhibiting valve, it has been determined that certain improvements can be made to that valve. While certain components and parts of the present invention bear some relationship and resemblance to components disclosed in U.S. Pat. No. 6,368,169 certain characteristics of the components have been changed dramatically in order to provide specific improvements in operation compared to the operation of the siphon inhibiting valve using a spherical ball as its movable member.

FIG. 1 is an exploded view showing the components of a marine engine cooling system. In the exploded view, various water paths are represented by various series of aligned arrows. These individual flow paths will be identified by specific reference numerals in the following description.

A pump 10 draws water from an intake 12 along a flow path 14. The water intake 12 is disposed below the surface of a body of water in which the marine propulsion system is operating. Whether the body of water is a lake or sea, the water is drawn along flow path 14 by the pump 10 and induced to flow under pressure along flow path 18 and into the cooling passages of the cooling system. As an example, the power steering cooler 19, fuel cooler 20, and an engine oil cooler 22 are shown connected in fluid communication with the conduits that conduct the flow path 18 toward a thermostat housing and cover assembly 30. From the thermostat housing 30, the cooling water is conducted along flow path 32 to an engine water circulating pump 36. From the engine water circulating pump 36, water is directed along two generally parallel flow paths, 41 and 42, into the engine 50. After passing through the cooling passages within the structure of the engine 50, the cooling water flows, along flow path 52, back to an inlet of the thermostat housing 30. From the thermostat housing 30, water flows in two parallel flow paths, 61 and 62, to the water jackets of the exhaust manifolds, 71 and 72. After passing through the water jackets of the manifolds, 71 and 72, the cooling water then flows into the exhaust elbows, 77 and 78, along flow paths 81 and 82. From there, the water is ejected with the exhaust gases as represented by flow paths 91 and 92.

When the engine 50 is turned off and the pump 10 becomes inactive, water can drain from the pump 10, in conduit 94, in a direction opposite to flow path 14. As this water in conduit 94 drains back into the body of water from which it was originally drawn, it can create a siphon effect which draws water from conduit 96 in a direction opposite to flow path 18. As a result of this siphon effect, water can be drawn from various portions of the cooling system and away from certain heat producing components, such as the engine 50 and exhaust manifolds, 71 and 72. This prevents the water from remaining in its intended locations to remove additional heat from the heat producing components. As described above in greater detail, the siphon effect can draw heated water back into the fuel/water heat exchanger and result in vaporization of the fuel in the heat exchanger. It should be understood that after the engine 50 is turned off, heat continues to radiate from the engine and be conducted into other various other components, particularly fuel containing and conducting components. As a result, these components experience a significant temperature rise after the engine is turned off. This temperature rise can create vapor lock problems when the operator of the marine vessel attempts to restart the engine. These vapor lock problems can be prevented if the cooling water remains within the cooling system in thermal communication with the heat producing components.

A siphon inhibiting device 100 is provided in series between the pump 10 and the heat producing components. The purpose of the siphon inhibiting device 100 is to prevent the flow of water within conduit 96, in a direction opposite to flow path 18, resulting from a siphon effect that is initiated by water draining from the pump 10 back into the body of water in a direction opposite to the flow path 14.

Figure 2:
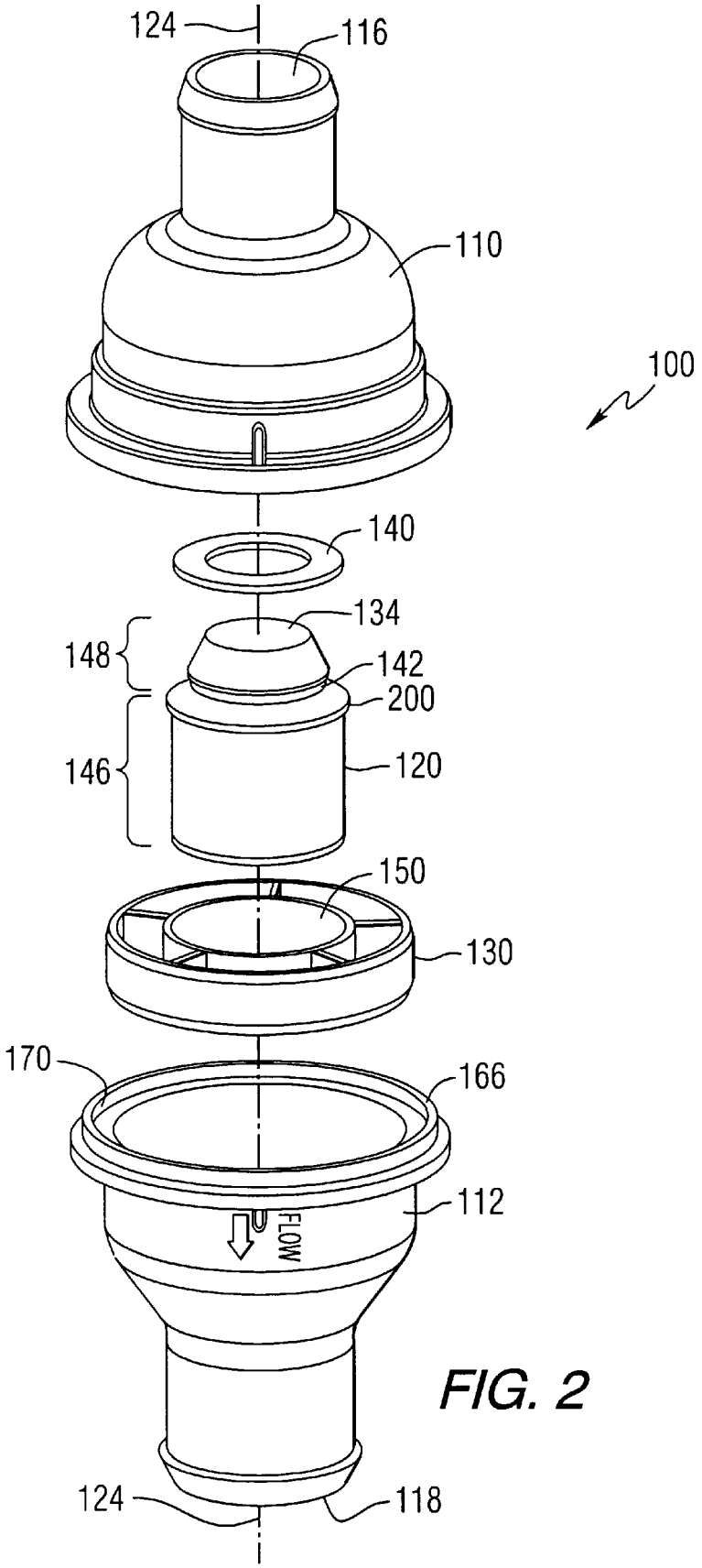
FIG. 2 is an exploded isometric view of a siphon inhibiting valve made in accordance with the present invention.

FIG. 2 is an exploded isometric view of a siphon inhibiting device 100 made in accordance with a preferred embodiment of the present invention. A housing structure, which is shown in FIG. 2 as comprising a first portion 110 and a second portion 112, provides an inlet port 116 and an outlet port 118. A buoyant member 120 is disposed for movement along a first axis 124 within the housing structure. Ports 116 and 118 are intentionally made of different sizes in order to create a keying effect. These different sizes prevent the device from being installed in a reverse configuration to that which is intended. The buoyant member 120 is inhibited, by a guide member 130, from rotating about any second axis which is perpendicular to the first axis 124. In other words, the generally blunt face 134 of the buoyant member 120 is maintained in a direction facing the inlet port 116 and the guide member 130 inhibits the buoyant member 120 from rotating in any direction that places the generally blunt face 134 in a direction facing away from the inlet port 116.

An elastomeric ring 140 is disposed in a slot 142 of the buoyant member 120 to provide a sealing surface of the buoyant member 120 which is movable into contact with the housing structure proximate the inlet port. Although not visible in FIG. 2, a lip is provided on the inner surface of the first portion 110 which cooperates with the elastomeric ring 140 to provide a seal which prevents movement of fluid in an upward direction along the first axis 124 and out of the inlet port 116 when the buoyant member 120 is in its uppermost position. This function will be described in greater detail below.

With continued reference to FIG. 2, it can be seen that the buoyant member 120 comprises a generally cylindrical portion 146 and an upper portion 148 which is formed in the shape of a frustum of a cone with the generally blunt face 134 at an upper end and the slot 142 located in the region where the frustum of the cone 148 is attached to the generally cylindrical portion 146. The guide member 130 is provided with an opening 150 that is shaped to receive the generally cylindrical portion 146 of the buoyant member 120 in sliding relation therein. Although the guide member 130 can allow the buoyant member 120 to rotate about the first axis 124, the buoyant member 120 is inhibited by the guide member 130 from rotating about any axis perpendicular to the first axis 124.

Figure 3:
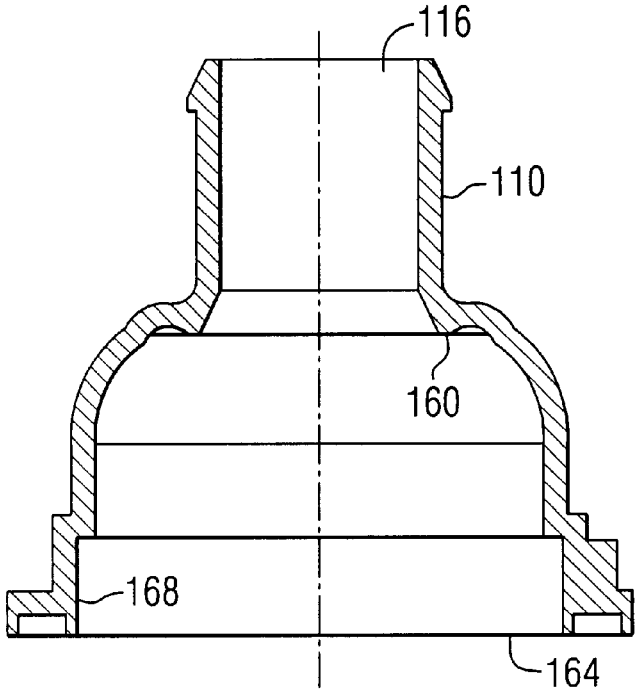
FIG. 3 is a section view of a first portion of the housing structure.

FIG. 3 is a sectional view of the first portion 110 of the housing structure of the present invention. A lip 160 is formed in the housing structure surrounding the inlet port 116. The lip 160 is shaped to cooperate with the elastomeric ring 140 that serves as the sealing surface of the buoyant member 120. End 164 of the first portion 110 is shaped to receive end 166 of the second portion 112, shown in FIG. 2. In addition, a generally cylindrical opening 168 is formed in the first portion 110 and a similar opening 170 is formed in the second portion 112 to provide a structure that captivates the guide member 130 in a manner that will be described in greater detail below.

Figure 4:
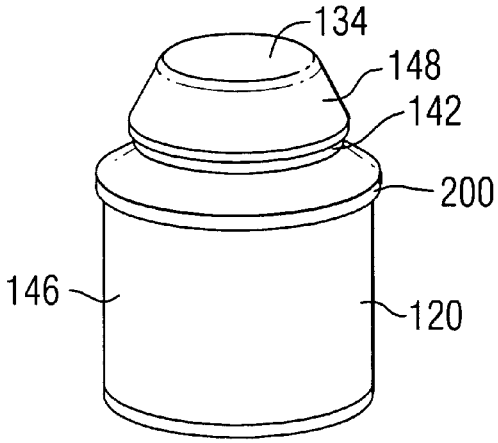
FIG. 4 is an isometric view of the buoyant member of the present invention.

FIG. 4 is an isometric view of the buoyant member 120 with its frustum of a cone portion 148 and its generally cylindrical portion 146. The slot 142 is shaped to receive the elastomeric ring 140, as described above in conjunction with FIG. 2, and the frustum of the cone 148 provides a generally blunt face 134.

Figure 5:
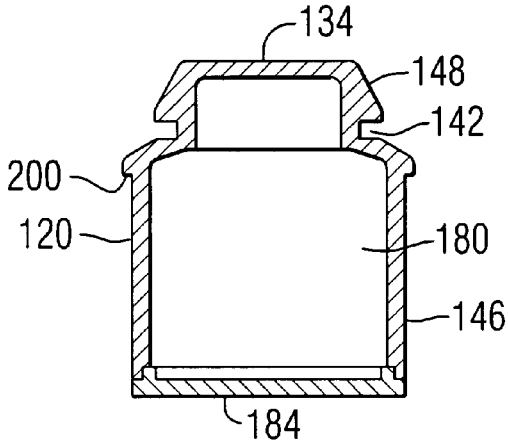
FIG. 5 is a section view of the buoyant member.

FIG. 5 is a section view of the buoyant member 120. As illustrated in FIG. 5, the buoyant member 120 is generally hollow with a cavity 180 formed inside the buoyant member 120. This cavity 180 helps to provide the required buoyancy of the buoyant member 120. As can be seen in FIG. 5, the cavity 180 is enclosed by a bottom cap 184 which is attached to the general cylindrical portion 146 to seal the cavity 180.

Figure 6:
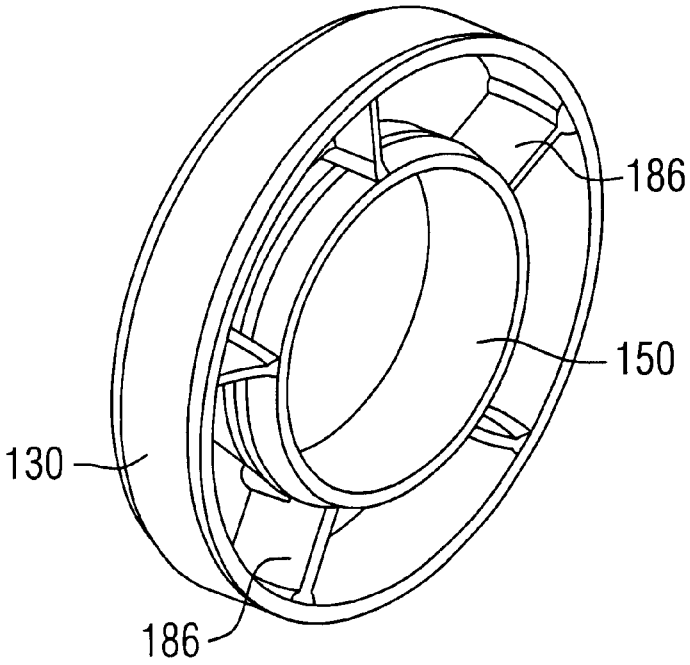
FIGS. 6 and 7 are two views of a guide member.
Figure 7:
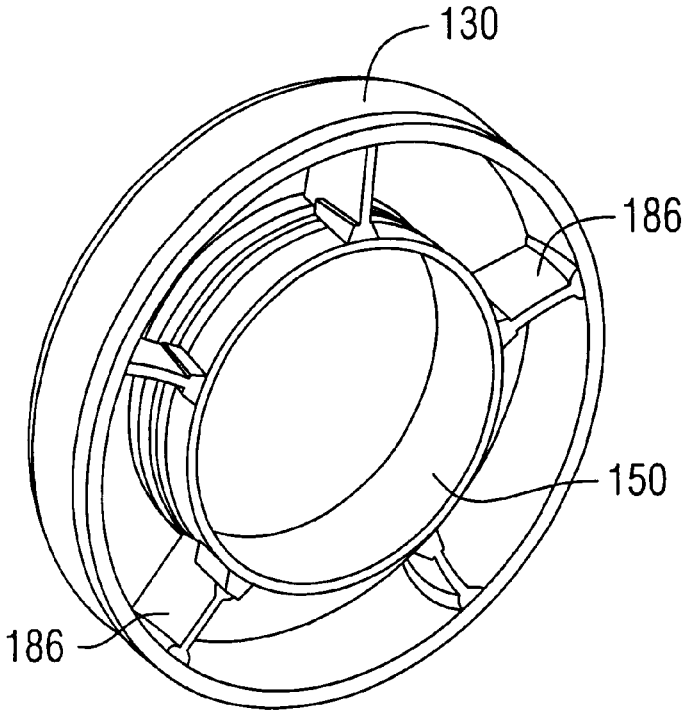

FIGS. 6 and 7 are isometric views of the guide member 130 viewed from the outlet port 118 and inlet port 124, respectively. The opening 150 is provided in the center portion of the guide member 130 and shaped to receive the cylindrical portion 146 of the buoyant member 120. Around the opening 150, a plurality of ribs 186 support the central ring and position the opening 150 at the central portion of the guide member 130 and, as a result, at the central portion of the chamber formed within the housing structure and generally symmetrical about the first axis 124. Between the ribs 186, flow passages are provided around the opening 150 in which the generally cylindrical portion 146 is disposed in sliding relation.

Figure 8:
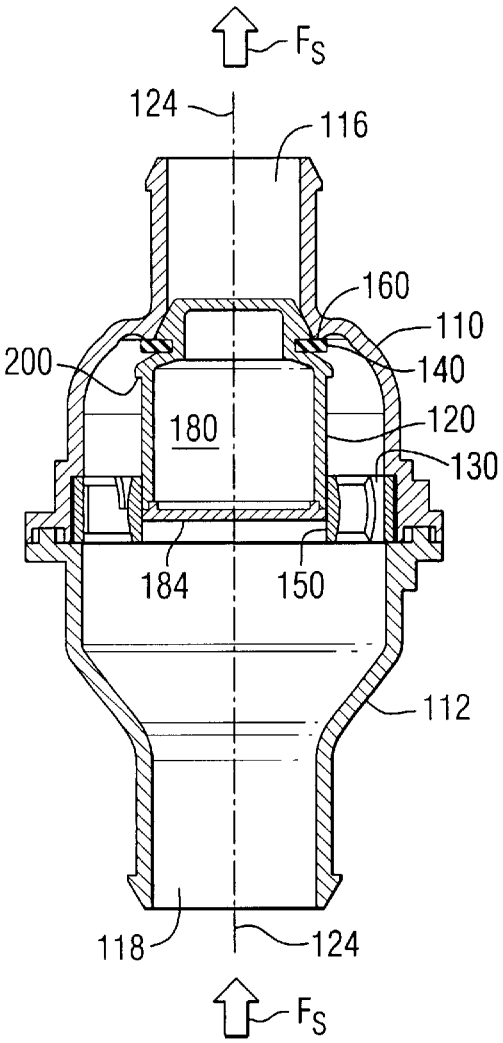
FIGS. 8 and 9 are two views of the present invention in a closed and opened position, respectively.
Figure 9:
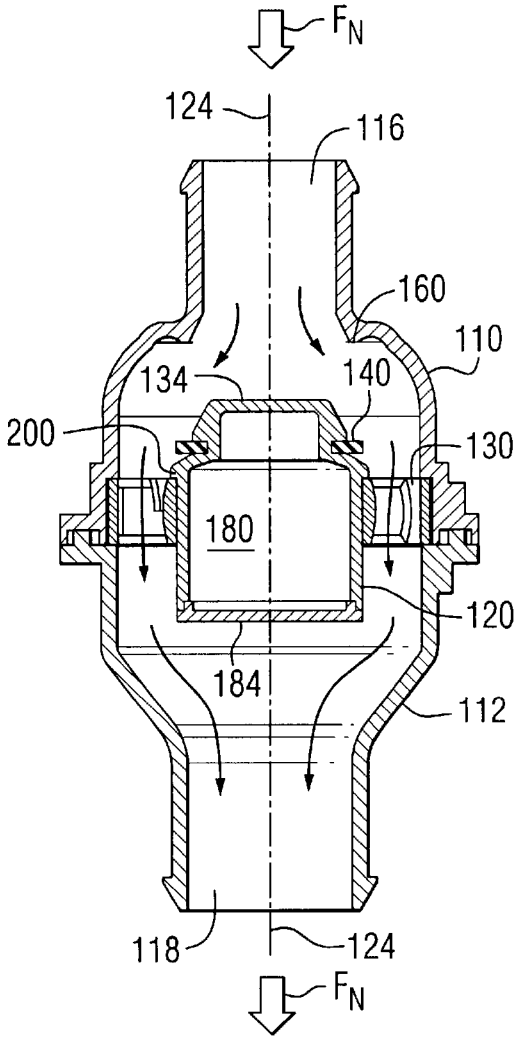

FIGS. 8 and 9 show the valve of the present invention in a closed state and in an opened state, respectively. In FIGS. 8 and 9, arrows $F_N$ show the normal flow direction of cooling water when the engine of the marine propulsion system is operating. FIG. 8 shows the valve in a condition when the water pump is not operating to draw water from a body of water and, as a result, to cause the water to be pumped toward and into cooling passages of the engine during operation of the marine propulsion system. Arrows $F_S$ illustrate the direction that a siphon would attempt to cause water to flow when the marine propulsion system is turned off and a siphon flow begins as water drains from the drive unit into the body of water. As described above in conjunction with FIG. 1, this draining of the drive unit of the marine propulsion unit can induce a siphon flow $F_S$ if no other precautions are taken. This siphon flow $F_S$ could cause most of the water within the cooling system of the engine to flow in a reverse direction through the cooling passages and into the body of water.

With reference to FIG. 8, the buoyant member 120 floats upward within the water contained in the housing structure and its connected conduits and moves into a sealing position with its elastomeric ring 140 moved into contact, in a normal direction, with the lip 160. The opening 150 of the guide member 130 maintains the buoyant member 120 in a proper position to assure that the sealing surface of elastomeric ring 140 moves into normal contact with the lip 160. Although the buoyant member 120 is able to rotate about the first axis 124, it is prevented from tilting or rotating about axes that are perpendicular to the first axis 124 because of the association between the opening 150 and the cylindrical portion of the buoyant member 120.

With continued reference to FIG. 8, the buoyant member 120 is urged in an upward direction because of its minimized weight, its relative large displacement of water, and the resulting nominal buoyancy force of approximately 0.079 lbs. In addition, when the cooling conduits are filled with water, the valve is positioned so that a head pressure due to trapped water within the cooling system also provides a net upward force against the bottom portion of the buoyant member 120. The combination of these effects forces the buoyant member 120 in a direction toward the inlet port 116 and, as a result, force the sealing surface of elastomeric ring 140 against the lip 160, in a normal direction, to prevent a flow $F_S$ of water in an upward direction within FIG. 8. As discussed above, this upward flow $F_S$ of water would otherwise be induced by the siphon effect caused by water draining from the drive unit into the body of water.

FIG. 9 shows the position of the buoyant member 120 when water is pumped through the cooling system during regular operation of the engine and water pump 10. Water flows in a downward direction into the inlet port 116. The force of the water against the generally blunt face 134 causes the buoyant member 120 to be forced downward relative to the guide member 130. With reference to FIGS. 2, 4, 5, 8, and 9, it can be seen that a rim 200 is formed around the buoyant member 120 at an upper region of the cylindrical portion 146. This rim 200 is shaped to provide a ledge that is larger in diameter than the inner diameter of opening 150. This rim 200 moves downward and into contact with the upper surface of the guide member 130 to effectively block the flow of water through the small annular gap between the outer cylindrical surface of the cylindrical portion 146 and the inner cylindrical surface of the opening 150. This forces all of the water in FIG. 9 to flow through the openings between the ribs 186. The rim 200 therefore prevents debris from flowing into this annular space and forces any debris in the cooling water to flow through the opening between the ribs 186 of the guide member 130. The regular flow $F_N$ of coolant water keeps the buoyant member 120 in its position shown in FIG. 9 with the rim 200 forced downward against the upper surface of the guide member 130. A high pressure region against the generally blunt face 134, coupled with a low pressure region below the bottom cap 184, maintains the buoyant member 120 in the position shown in FIG. 9 and prevents any upward movement during normal operation of the marine propulsion system.

When the marine propulsion system is turned off and water is no longer pumped from the body of water in which the marine vessel is operated, the normal buoyancy of the buoyant member 120 combined with the head pressure due to trapped water in the cooling system cause the buoyant member 120 to rise upward and assume the position shown in FIG. 8, thereby preventing any flow of water in the siphoning direction $F_S$.

The structure of the valve of the present invention allows water to flow through the valve in an unimpeded manner when the engine is operating. Although it is recognized that the buoyant member 120 blocks a small portion of the flow path within the housing structure, this blockage is minimized and a sufficient normal flow $F_N$ of cooling water is allowed to pass through the spaces between the ribs 186 of the guide member 130, as shown in FIG. 9. When the engine is turned off, the buoyant member 120 rises rapidly following the cessation of the normal flow $F_N$ as a result of the buoyancy of the buoyant member 120 and the head pressure which is greater against the bottom cap 184 than against the blunt face 134. This rapid upward movement, from the position shown in FIG. 9 to the position shown in FIG. 8, prevents the hot water in the engine block and cylinder heads from flowing in a reverse siphon direction $F_S$ and leaving fuel heat exchangers without sufficient cooling water. Otherwise, vapor lock could be caused if some of the cooling water is allowed to be siphoned out of the cooling passages of the marine propulsion system.

The valve of the present invention opens quickly under the influence of the weight of the valve itself and water upstream from the buoyant member 120 and the valve when the downstream water is removed, as when the cooling system is drained. In other words, when the operator of the marine vessel takes steps to allow water to drain from the system, the water flows away from the valve through the outlet port 118. The weight of the buoyant member 120, combined with the weight of water in the inlet 116 and associated conduits, forces the buoyant member 120 downward toward the position shown in FIG. 9. This allows all of the water to drain from the cooling system when the system is being drained. This, in turn, prevents damage from occurring to the system due to freezing of entrained water.

The shape of the buoyant member 120 also avoids any oscillation of the buoyant member within the housing structure. Under operating conditions, the flow $F_N$ holds the buoyant member 120 firmly against the guide member 130, as shown in FIG. 9. The high velocity incoming water, flowing into the valve through the inlet port 116, impinges against the blunt face 134 of the buoyant member 120 and the trailing edge geometry at the bottom portion of the buoyant member 120 creates a low pressure region immediately below the buoyant member. These forces hold the buoyant member 120 downward in the position shown in FIG. 9 when a normal flow $F_N$ of water passes through the valve.

The present invention provides a valve that allows water to pass with minimal restriction through the valve when the buoyant member 120 is in the position shown in FIG. 9. In a preferred embodiment of the present invention, a loss of one gallon per minute at wide open throttle (WOT) of boat operation has been observed. Empirical data taken both with and without the valve in the system shows that less than one gallon per minute flow decrease was observed in a marine propulsion system that normally conducts 39 gallons per minute through the cooling system at wide open throttle. In addition, the present invention creates an improved sealing pressure than prior art valves, such as that described in U.S. patent application Ser. No. 09/717,773 and illustrated in FIG. 2 of that patent application. In other words, one embodiment of the present invention provides an upward sealing pressure between the sealing surface of elastomeric ring 140 and the lip 160 which is approximately 2.84 PSI, whereas this sealing pressure is less than 1.0 PSI in some prior art valves even when a mechanical spring is used to assist in sealing.

The use of an elastomeric seal in the present invention has been shown to effectively seal and minimize leakage in the direction represented by arrow $F_S$ in FIG. 8. This decrease in leakage is due largely to the relatively large sealing pressure described above and the geometry of the raised lip 160. As such, the present invention easily meets a maximum allowable water leak rate of 8 cubic centimeters per minute at pressures of 50 psi or less. Empirical tests show a leak rate much less than this maximum limit. The rubber seal is mechanically fixed to the buoyant member 120 by friction in slot 142, as shown in FIGS. 8 and 9, and is presented to the lip 160 in a normal direction. As a result, there is no tendency for this structure to stick as was possible in certain prior art structures and no wedging occurs at the sealing surface because only contact between the sealing surface of elastomeric ring 140 and the lip 160 is permitted. The guide member 130 provides a structure that prevents the buoyant member 120 from moving out of line. With reference to FIGS. 2, 8, and 9, it can be seen that the guide member 130 is captured between the first and second portions, 110 and 112, of the housing structure for easy assembly. The rim 200 covers any clearance that exists between the cylindrical portion 146 of the buoyant member 120 and the internal cylindrical surface of opening 150 of the guide member 130. This prevents debris from wedging in this annular gap. The structure of the present invention allows all of its components, except the elastomeric seal 140 to be injection molding from plastic material. This significantly reduces its costs.

Although the present invention has been described in particular detail and illustrated to show a particularly preferred embodiment of the present invention, it should be understood that alternative embodiments are also within its scope.

I claim:

1. A siphon inhibiting valve for a marine propulsion system, comprising:

a housing structure having an inlet port and an outlet port;

a buoyant member disposed for movement along a first axis within said housing structure, said buoyant member being inhibited from rotating about a second axis which is perpendicular to said first axis; and a sealing surface of said buoyant member which is movable into contact with said housing structure proximate said inlet port, in response to movement of said buoyant member toward said inlet port, to inhibit a liquid from flowing in a direction from said outlet port through said inlet port, said housing structure being connected in fluid communication with a cooling system of a marine propulsion system with said inlet port being disposed upstream from said outlet port within said cooling system to receive cooling water from a body of water and said outlet port being disposed downstream from said inlet port within said cooling system to conduct water to a cooling system of an engine of said marine propulsion system.

2. The valve of claim 1, further comprising:

a guide member disposed within said housing structure and having an opening formed therein which is shaped to receive said buoyant member in sliding relation therein.

3. The valve of claim 1, wherein:

said housing structure comprises a first portion and a second portion.

4. The valve of claim 1, wherein:

said buoyant member comprises a generally cylindrical portion and a portion which is a frustum of a cone.

5. The valve of claim 1, wherein:

said sealing surface of said buoyant member comprises an elastomeric insert attached to said buoyant member.

6. The valve of claim 5, further comprising:

a lip formed in said housing structure surrounding said inlet port, said elastomeric member being shaped to form a seal with said lip when said buoyant member moves toward said inlet port and into contact with said housing structure.

7. The valve of claim 5, wherein:

said elastomeric insert is a ring that is shaped to be received in a slot formed in said buoyant member.

8. The valve of claim 1, wherein:

said buoyant member is rotatable about said first axis.

9. The valve of claim 1, wherein:

said buoyant member is at least partially hollow.

10. The valve of claim 1, wherein:

said buoyant member having a generally blunt face at an end of said buoyant member most proximate said inlet port, whereby said buoyant member being inhibited from rotating about said second axis which is perpendicular to said first axis causes said generally blunt face to be maintained in a position facing said inlet port.

11. A siphon inhibiting valve for a marine propulsion system, comprising:

a housing structure comprising a first portion and a second portion and having an inlet port and an outlet port;

a buoyant member disposed for movement along a first axis within said housing structure, said buoyant member having a generally blunt face at an end of said buoyant member most proximate said inlet port, said buoyant member being inhibited from rotating about a second axis which is perpendicular to said first axis whereby said generally blunt face is maintained in a position facing said inlet port, said buoyant member comprising a tapered portion extending with an increasing width from said generally blunt face;

a guide member disposed within said housing structure and having an opening formed therein which is shaped to receive said buoyant member in sliding relation therein; and a sealing surface of said buoyant member which is movable into contact with said housing structure proximate said inlet port to prevent a liquid from flowing in a direction from said outlet port through said inlet port, said housing structure being connected in fluid communication with a cooling system of a marine propulsion system with said inlet port being disposed upstream from said outlet port within said cooling system to receive cooling water from a body of water and said outlet port being disposed downstream from said inlet port within said cooling system to conduct water to a cooling system of an engine of said marine propulsion system.

12. The valve of claim 11, wherein:

said tapered portion is a frustum of a cone.

13. The valve of claim 12, wherein:

said buoyant member comprises a generally cylindrical portion attached to said frustum of a cone.

14. The valve of claim 13, wherein:

said sealing surface of said buoyant member comprises an elastomeric insert attached to said buoyant member.

15. The valve of claim 14, further comprising:

a lip formed in said housing structure surrounding said inlet port, said elastomeric member being shaped to form a seal with said lip when said buoyant member moves toward said inlet port and into contact with said housing structure.

16. The valve of claim 15, wherein:

said elastomeric insert is a ring that is shaped to be received in a slot formed in said buoyant member.

17. The valve of claim 16, wherein:

said buoyant member is rotatable about said first axis and said buoyant member is at least partially hollow.

18. A siphon inhibiting valve for a marine propulsion system, comprising:

a housing structure comprising a first portion and a second portion and having an inlet port and an outlet port;

a buoyant member disposed for movement along a first axis within said housing structure, said buoyant member being rotatable about said first axis, said buoyant member having a generally blunt face at an end of said buoyant member most proximate said inlet port, said buoyant member being inhibited from rotating about a second axis which is perpendicular to said first axis whereby said generally blunt face is maintained in a position facing said inlet port, said buoyant member comprising a frustum of a cone portion extending with an increasing width from said generally blunt face, said buoyant member comprising a generally cylindrical portion attached to said frustum of a cone portion;

a guide member disposed within said housing structure and having an opening formed therein which is shaped to receive said buoyant member in sliding relation therein;

an elastomeric sealing surface, inserted into a groove of said buoyant member, which is movable into contact with said housing structure proximate said inlet port to prevent a liquid from flowing in a direction from said outlet port through said inlet port; and a lip formed in said housing structure surrounding said inlet port, said elastomeric member being shaped to form a seal with said lip when said buoyant member moves toward said inlet port and into contact with said housing structure, said housing structure being connected in fluid communication with a cooling system of a marine propulsion system with said inlet port being disposed upstream from said outlet port within said cooling system to receive cooling water from a body of water and said outlet port being disposed downstream from said inlet port within said cooling system to conduct water to a cooling system of an engine of said marine propulsion system.

* * * * *